US009783397B2

(12) United States Patent
Terata et al.

(10) Patent No.: US 9,783,397 B2
(45) Date of Patent: Oct. 10, 2017

(54) WORK STATE MONITORING DEVICE FOR WORK VEHICLE

(71) Applicant: TADANO LTD., Kagawa (JP)

(72) Inventors: Kimihiko Terata, Kagawa (JP); Hiroshi Yamauchi, Kagawa (JP)

(73) Assignee: TADANO LTD., Kagawa (JP)

( * ) Notice: Subject to any disclaimer, the term of this patent is extended or adjusted under 35 U.S.C. 154(b) by 50 days.

(21) Appl. No.: 14/781,286

(22) PCT Filed: Mar. 20, 2014

(86) PCT No.: PCT/JP2014/057768

§ 371 (c)(1),
(2) Date: Sep. 29, 2015

(87) PCT Pub. No.: WO2014/162894

PCT Pub. Date: Oct. 9, 2014

(65) Prior Publication Data

US 2016/0318739 A1 Nov. 3, 2016

(30) Foreign Application Priority Data

Apr. 2, 2013 (JP) ..... 2013-076997

(51) Int. Cl.
*B66C 23/90* (2006.01)
*B66C 13/16* (2006.01)
(Continued)

(52) U.S. Cl.
CPC ..... *B66C 23/905* (2013.01); *B66C 13/16* (2013.01); *B66C 15/065* (2013.01); *B66C 23/42* (2013.01);
(Continued)

(58) Field of Classification Search
CPC ..... B66C 23/00; B66C 23/60; B66C 2700/00; B66C 13/16; B66C 13/46; B66C 23/90;
(Continued)

(56) References Cited

U.S. PATENT DOCUMENTS 3,819,922 A * 6/1974 Horn ..... E02F 9/26 212/278
5,160,056 A * 11/1992 Yoshimatsu ..... B66C 23/905 212/277
(Continued)

FOREIGN PATENT DOCUMENTS

CN 102020201 A 4/2011
CN 102862915 A 1/2013
(Continued)

OTHER PUBLICATIONS

International Search Report issued in Application No. PCT/JP2014/057768, dated Jun. 24, 2014 and translation thereof (5 pages).
(Continued)

*Primary Examiner* — Thomas G Black
*Assistant Examiner* — Sara J Lewandroski
(74) *Attorney, Agent, or Firm* — Nakanishi IP Associates, LLC

(57) ABSTRACT

A work state monitoring device for a work vehicle is provided, such that an operator can perform the work without receiving a warning. The work state monitoring device acquires a current work state of a crane using work posture detectors. A calculator calculates at least a predetermined work state corresponding to a warning load factor based on the current work state acquired by the work posture detectors. A monitor informs an operator of the predetermined work state calculated by the calculator.

5 Claims, 5 Drawing Sheets

(51) Int. Cl.

| | |
|---|---|
| ***B66C 15/06*** | (2006.01) |
| *G07C 5/08* | (2006.01) |
| *G07C 5/12* | (2006.01) |
| *B66C 23/42* | (2006.01) |

(52) U.S. Cl.
CPC ..... *B66C 2700/084* (2013.01); *G07C 5/08* (2013.01); *G07C 5/0816* (2013.01); *G07C 5/12* (2013.01)

(58) Field of Classification Search
CPC ..... B66C 23/905; B66C 15/06; B66C 15/065; B66C 13/18; B66C 13/22; B66C 23/88; B66C 25/00; B66C 2700/08; B66C 2700/084; B66C 2700/088; B66C 15/00; G07C 5/00; G07C 5/02; G07C 5/06; G07C 5/08; G07C 5/0816; G07C 5/12
See application file for complete search history.

(56) References Cited

U.S. PATENT DOCUMENTS

| | | | | |
|---|---|---|---|---|
| 5,217,126 | A * | 6/1993 | Hayashi | B66C 23/905 212/277 |
| 6,170,681 | B1 * | 1/2001 | Yoshimatsu | B66C 23/905 212/278 |
| 2001/0032826 | A1 * | 10/2001 | Nishikino | B66C 23/905 212/278 |
| 2003/0090384 | A1 * | 5/2003 | Nishimura | E02F 3/962 340/685 |
| 2005/0192732 | A1 * | 9/2005 | Narisawa | B66C 23/905 701/50 |
| 2011/0062104 | A1 | 3/2011 | Schneider | |
| 2012/0185159 | A1 * | 7/2012 | Yamauchi | B66C 13/16 701/123 |
| 2013/0013144 | A1 | 1/2013 | Tanizumi | |
| 2013/0034415 | A1 * | 2/2013 | Ogita | B60P 1/6472 414/546 |
| 2013/0066527 | A1 * | 3/2013 | Mizuochi | B66C 23/905 701/50 |
| 2013/0168345 | A1 * | 7/2013 | Hey | B66C 23/52 212/276 |
| 2013/0253759 | A1 * | 9/2013 | Matsumoto | B66C 23/905 701/31.1 |
| 2015/0217976 | A1 * | 8/2015 | Tanizumi | B66C 13/46 703/2 |

FOREIGN PATENT DOCUMENTS

| | | | | |
|---|---|---|---|---|
| EP | 1180490 | A2 | | 2/2002 |
| JP | H07-81886 | A | | 3/1995 |
| JP | H10-157984 | A | | 6/1998 |
| JP | H11-310393 | A | | 11/1999 |
| JP | 3136110 | B2 | | 2/2001 |
| JP | 2001-341983 | A | | 12/2001 |
| JP | 2002-241083 | A | | 8/2002 |
| JP | 2002241083 | A | * | 8/2002 |
| JP | 2003-300690 | A | | 10/2003 |
| JP | 2005-1847 | A | | 1/2005 |
| JP | 2008-94623 | A | | 4/2008 |
| JP | 2013-52991 | A | | 3/2013 |
| JP | 2013052991 | A | * | 3/2013 |

OTHER PUBLICATIONS

International Preliminary Examination Report issued in Application No. PCT/JP2014/057768, dated Jul. 28, 2015 (23 pages).

* cited by examiner

WORK STATE MONITORING DEVICE FOR WORK VEHICLE

CROSS-REFERENCE TO RELATED APPLICATION

The present application is based on and claims priority to Japanese patent application No. 2013-076997, filed on Apr. 2, 2013, the disclosure of which is hereby incorporated by reference herein in its entirety.

This invention is related to a work state monitoring device that is used by an operator of a work vehicle, such as a crane, to monitor a work state of the vehicle.

BACKGROUND ART

Conventionally, a work state monitoring device has been used for an operator to monitor the work state of a work vehicle such as a crane.

Some of the conventional work state monitoring devices which are configured to generate a graph of total rated weights (at 100% load factor) related to working radiuses are taught by, for example, Japanese Patent No. 3,136,110. In the work state monitoring device of this conventional technique, when the current weight is close to or even surpasses the total rated weight, the work is forcibly terminated and the weight is decreased to be within a range indicated by the graph.

In other work state monitoring devices, operators are warned by, for example a yellow light installed on the work vehicle when the current weight is close to the total rated weight, and the operators are warned by a red light when the current weight reaches the total rated weight.

SUMMARY

In some of work sites, the operators are expected not to light the yellow light (i.e., not to be warned by the yellow light). However, the operators of the conventional device can only know the work state (e.g., loads and/or working radiuses) shown by the graph at 100% load factor. Therefore, it is difficult for the operators to perform the work without lighting the yellow light.

In order to solve the above problem, an object of this invention is, therefore, to provide a work state monitoring device for a work vehicle such that an operator can perform the work without receiving a warning.

In order to solve the above problem, the inventor of the present invention has invented a work state monitoring device for a work vehicle as described below.

A work state monitoring device for a work vehicle of the present invention includes a work state acquisition section that acquires a current work state of the work vehicle, a calculator that calculates at least a predetermined work state, which is a work state prior to receiving a warning, corresponding to a load factor set lower than a warning load factor to generate the warning based on the current work state acquired by the work state acquisition section, and an informer that informs an operator of the information regarding the predetermined work state calculated by the calculator.

DESCRIPTION OF EMBODIMENT

Hereinafter, an embodiment of the present invention will be explained with reference to the drawings.

Embodiment

Figure 1:
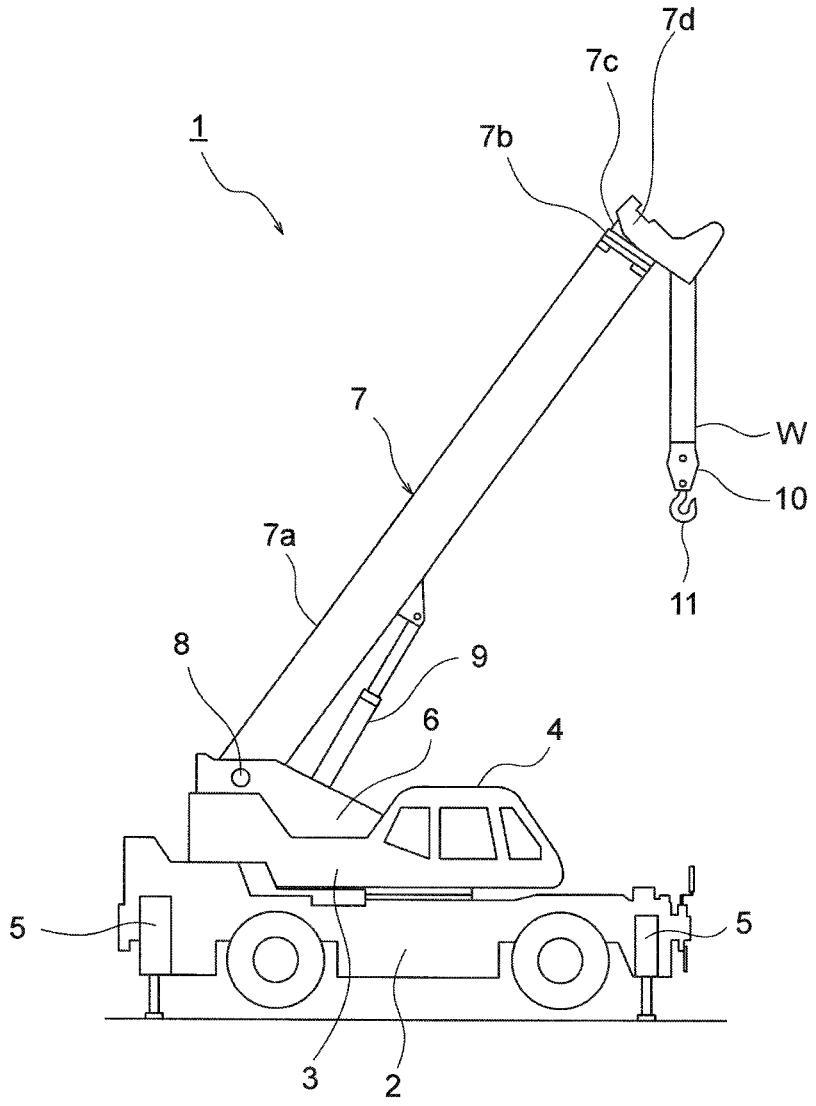
FIG. 1 is a side view illustrating a crane of an embodiment according to a present invention.

FIG. 1 is a side view illustrating a crane 1 of an embodiment according to a present invention. An overall structure of the crane 1 will be explained first. The crane 1 includes a carrier 2, which is a main body of a vehicle (vehicle body) capable of traveling, a swivel base 3 attached on top of the carrier 2 to be horizontally rotatable, and a cabin 4 provided above the swivel base 3.

On each of the front side and back side of the carrier 2, a pair of left and right outriggers 5 (only one of them are illustrated) are provided. On the swivel base 3, a bracket 6 is fixed. The bracket 6 has a boom 7. The boom 7 corresponds to a working device of the present invention.

The boom 7 is connected to the bracket 6 at the base part of the boom 7 with a support shaft 8 and is risen up and fallen down around the support shaft 8. A boom cylinder 9 is interposed between the bracket 6 and the boom 7. The boom 7 can rise up and fall down as the boom cylinder 9 extends and retracts.

The boom 7 has a base boom section 7*a*, an intermediate boom section 7*b*, and a top boom section 7*c*. The top boom section 7*c* is accommodated in the intermediate boom section 7*b*, and the intermediate boom section 7*b* is accommodated in the top boom section 7*c*. Each of the boom sections 7*a*-7*c* is connected via a telescopic cylinder (not illustrated) and are extended and retracted as the telescopic cylinder extends and retracts.

A boom head 7*d* of the top boom section 7*c* is provided with a sheave (not illustrated). The bracket 6 is provided with a winch (not illustrated). The winch suspends a wire W, and the wire W is wounded around the sheave. The wire W suspends a hook block 10 to which a hook 11 is attached. The hook 11 can hook goods (not illustrated) with a wire rope (not illustrated).

An operation unit (not illustrated in FIG. 1) is installed inside the cabin 4. The operation unit is manipulated by an operator to rotate the swivel base 3, to rise up and fall down the boom 7, to reel in and out the wire W with the winch, to extend and contracts the outriggers 5, to start and stop an engine, and the like.

Figure 2:
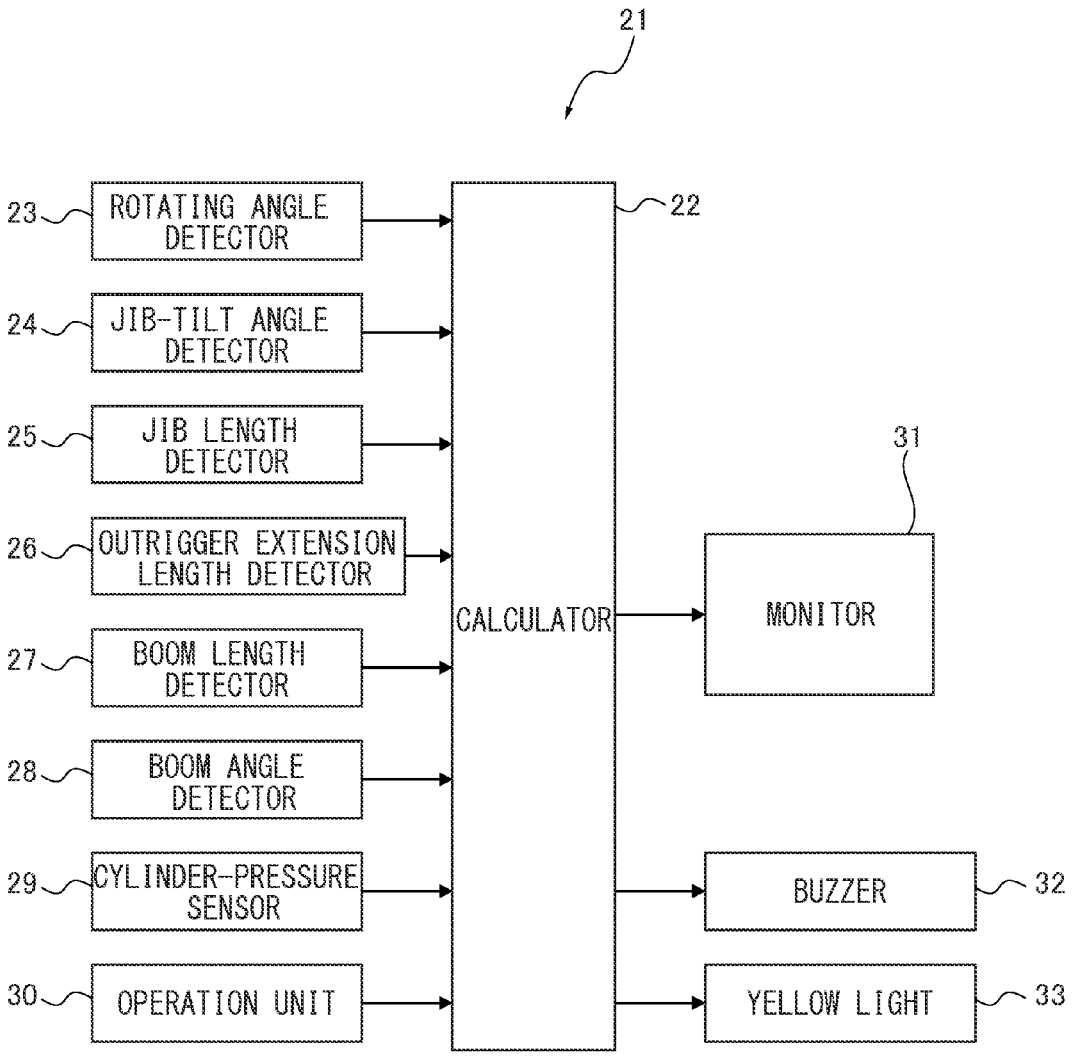
FIG. 2 is a block diagram showing a configuration of a work state monitoring device according to the embodiment installed in the crane.

FIG. 2 is a block diagram showing a configuration of a work state monitoring device 21 according to the present invention. The work state monitoring device 21 is installed on the crane 1. Based on a current work state, the work state monitoring device 21 calculates a predetermined work state, which is a work state prior to receiving a warning, corresponding to a predetermined load factor set lower than a warning load factor and informs the operator of the calculated predetermined work state. Note that the warning load factor is a load factor set to generate a warning.

The work state monitoring device 21 of this embodiment uses working radiuses or actual weights of the crane 1 as the information regarding the work state to be informed to the operator. Here, the working radiuses of the crane 1 mean horizontal distances from the rotation center of the boom 7 (i.e., the center of the connection point of the swivel base 3) to the edge of the boom 7. The actual weights of the crane 1 mean weights on the end part of the boom 7.

A main part of the work state monitoring device 21 is a calculator 22 for executing various calculation processes. The calculator 22 may be installed inside the cabin 4, for example.

On the input side of the calculator 22, a work posture detector (a rotating angle detector 23, a jib-tilt angle detector 24, a jib-length detector 25, an outrigger extension length detector 26, a boom length detector 27, a boom angle detector 28, and a cylinder-pressure sensor 29) and an operation unit 30 are connected. On the output side of the calculator 22, a monitor 31, a buzzer 32, and a yellow light 33 are connected.

In the work state monitoring device 21, a work state acquisition section according to the embodiment of the present invention is configured with the work posture detector. An informer of the present invention is configured with the monitor 31 and the buzzer 32.

The rotating angle detector 23 is attached to the swivel base 3 and detects rotation angles of the boom 7. The jib-tilt angle detector 24 is attached to a jib (not illustrated) and detects tilt angles of the jib (angle in the vertical direction). The jib-length detector 25 is attached to the jib and detects lengths of the jib.

The jib is used to support the work in a working area where the work vehicle cannot perform the work only with the boom 7. The jib is mounted beside the boom 7 or is brought to a work place separately, and attached to the top part of the boom 7 when needed.

The outrigger extension length detector 26 is attached to each outrigger 5 and detects extension lengths of each outrigger 5. The boom length detector 27 is attached to the boom 7 and detects lengths of the boom 7.

The boom angle detector 28 is attached to the boom 7 and detects derricking angles of the boom 7. The cylinder-pressure sensor 29 is attached to the boom cylinder 9 and detects pressures of the boom cylinder 9.

The operation unit 30, the monitor 31, and the buzzer 32 are provided inside the cabin 4 (illustrated in FIG. 1). The operation unit 30 is manipulated by the operator to input load factors and signals to turn ON/OFF the buzzer 32. Note that the operation unit 30 may be configured such that the operator can also input moment load factors.

The monitor 31 displays three load factors of the crane 1 and information (working radiuses and actual weights) regarding the work state of the crane 1.

The three load factors are an arbitrary load factor input by the operator through the operation unit 30, a warning load factor (e.g., 90%) representing a work state close to a work limit, and a limit load factor (e.g., 100%) representing the work limit. Note that the load factors displayed on the monitor 31 should not be limited to the above values and may be set arbitrarily.

The buzzer 32 gives a warning to the operator when the actual load factor reaches any of the three load factors. The yellow light 33 is installed on the crane 1 and lights when the actual load factor reaches the warning load factor (e.g., 90%).

Figure 3:
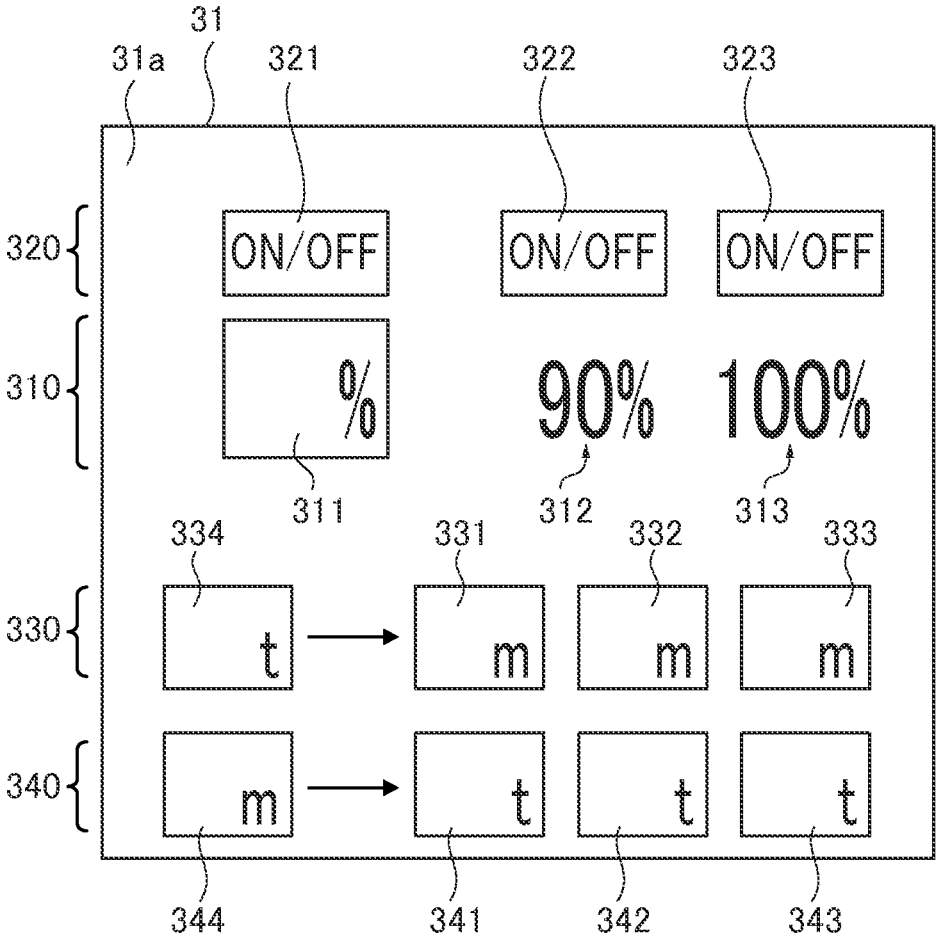
FIG. 3 is a view illustrating contents displayed on a monitor of FIG. 2.

FIG. 3 is a view illustrating contents displayed on the monitor 31. A load factors indicating section 310 is displayed in a top half portion of a screen 31*a* of the monitor 31. The load factors indicating section 310 has a first load factor indicator 311, a second load factor indicator 312, and a third load factor indicator 313 arranged from left to right.

The first load factor indicator 311 displays the arbitrary load factor input by the operator through the operation unit 30. The second load factor indicator 312 displays the warning load factor (e.g., 90%). The third load factor indicator 313 displays the limit load factor (e.g., 100%) to show the work limit.

The second load factor indicator 312 and the third load factor indicator 313 display the corresponding load factors once the work state monitoring device 21 is powered ON.

A buzzer states indicating section 320 is displayed above the load factors indicating section 310. The buzzer states indicating section 320 has a first buzzer state indicator 321, a second buzzer state indicator 322, and a third buzzer state indicator 323 above the load factor indicators 311 to 313 respectively. Each of the buzzer state indicators 321 to 323 displays the ON/OFF state of the buzzer 32.

A first work state indicating section 330 is displayed below the load factors indicating section 310. The first work state indicating section 330 has an actual weight indicator 334, a first working radius indicator 331, a second working radius indicator 332, and a third working radius indicator 333 arranged from left to right.

The actual weight indicator 334 displays the actual weight (current weight) corresponding to working posture of the work state monitoring device 21 when the device 21 is turned ON.

The first working radius indicator 331 displays a working radius corresponding to the load factor displayed on the first load factor indicator 311 (i.e., the arbitrary load factor input by the operator) under the current working posture.

The second working radius indicator 332 displays a working radius corresponding to the load factor displayed on the second load factor indicator 312 (i.e., the warning load factor) under the current working posture.

The third working radius indicator 333 displays a working radius corresponding to the load factor displayed on the third load factor indicator 313 (i.e., the limit load factor) under the current working posture.

A second work state indicating section 340 is displayed below the first work state indicating section 330. The second work state indicating section 340 has a current working radius indicator 344, a first weight indicator 341, a second weight indicator 342, and a third weight indicator 343 arranged from left to right.

The current working radius indicator 344 displays a working radius (current working radius) corresponding to the working posture of the work state monitoring device 21 when the device 21 is turned ON.

The first weight indicator 341 displays an actual weight corresponding to the load factor displayed on the first load factor indicator 311 (the arbitrary load factor input by the operator) under the current working posture.

The second weight indicator 342 displays an actual weight corresponding to the load factor displayed on the second load factor indicator 312 (the warning load factor) under the current working posture.

The third weight indicator 343 displays an actual weight corresponding to the load factor displayed on the third load factor indicator 313 (the limit load factor) under the current working posture.

Next, a process executed by the work state monitoring device 21 to display the work state will be explained. The process has a working radius indicating process and an actual weight indicating process. The working radius indicating process is a process to display the working radiuses corresponding to the load factors. The actual weight indicating process is a process to display the actual weights corresponding to the load factors. Each of the processes will be explained below.

(Load Radius Indicating Process)

Figure 4:
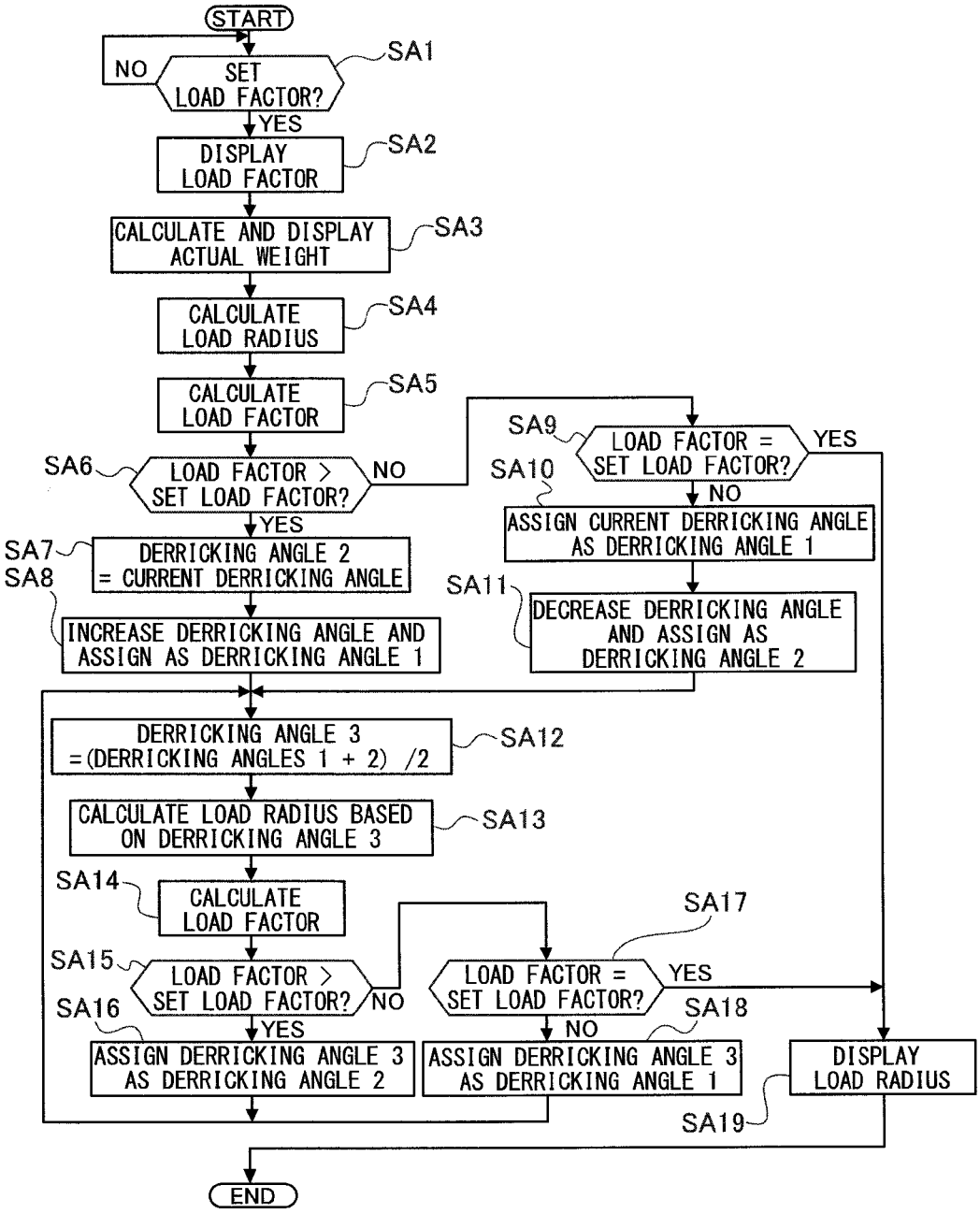
FIG. 4 is a flowchart showing processes executed by the work state monitoring device of the embodiment for displaying working radiuses.

First, the working radius indicating process will be explained with reference to FIG. 4 flowchart.

(Step SA1)

The calculator 22 determines whether the load factor is set or input by the operator through the operation unit 30. The load factor is set to be smaller than the warning load factor (90%) in advance. In this embodiment, the load factor is set to be 80%.

(Step SA2)

When it is determined that the load factor is input by the operator through the operation unit 30 (i.e., when the determination result in Step SA1 is YES), the calculator 22 displays the set load factor on the first load factor indicator 311 of the monitor 31 (see FIG. 3).

(Step SA3)

The calculator 22 calculates the current actual weight based on the pressure of the boom cylinder 9 detected by the cylinder-pressure sensor 29 and displays the calculated actual weight on the actual weight indicator 334 of the monitor 31.

(Step SA4)

The calculator 22 calculates the current working radius based on the derricking angle of the boom 7 detected by the boom angle detector 28, the current boom length of the boom 7 detected by the boom length detector 27, and the actual weight calculated in Step SA3.

(Steps SA5 to SA6)

The calculator 22 calculates the current load factor based on the current working radius calculated in the Step SA4 and determines whether the calculated current load factor is greater than the set load factor (i.e., the load factor input by the operator).

(Steps SA7 to SA8)

When it is determined that the current load factor is greater than the set load factor (i.e., when the determination result in Step SA6 is YES), the calculator 22 assigns the current derricking angle as a "derricking angle 2". The calculator 22 then adds a prearranged value to the current derricking angle and assigns the value-added angles as a "derricking angle 1" virtually.

(Step SA9)

When it is determined that the current load factor is not greater than the set load factor (i.e., when the determination result in Step SA6 is NO), the calculator 22 determines whether the current load factor is equal to the set load factor.

(Steps SA10 to SA11)

When it is determined that the current load factor is not equal to the set load factor, in other words, when it is determined that the current load factor is smaller than the set load factor (i.e., when the determination result in Step SA9 is NO); the calculator 22 assigns the current derricking angle as the "derricking angle 1". Further, the calculator 22 decreases a preset value from the current derricking angle and assigns the value-decreased angle as a "derricking angle 2" virtually.

(Step SA12)

Based on the "derricking angle 1" assigned in Step SA8 or Step SA10 and the "derricking angle 2" assigned in Step SA7 or Step SA11, the calculator 22 calculates a derricking angle 3 (virtual derricking angle) in accordance with the following equation:

$$\text{derricking angle 3}=(\text{derricking angle 1}+\text{derricking angle 2})/2.$$

(Step SA13)

The calculator 22 calculates the working radius (virtual working radius) based on the "derricking angle 3" calculated in Step SA12, the boom length of the boom 7 detected by the boom length detector 27, and the current actual weight calculated in Step SA3.

(Steps SA14 to SA15)

The calculator 22 calculates the load factor (virtual load factor) based on the working radius calculated in Step SA13 and determines whether the calculated load factor is greater than the set load factor.

(Step SA16)

When it is determined that the calculated load factor is greater than the set load factor (i.e., when the determination result in Step SA15 is YES), the calculator 22 assigns the "derricking angle 3" calculated in Step SA12 as the "derricking angle 2".

(Steps SA12 to SA16)

The calculator 22 re-calculates the "derricking angle 3" based on the newly assigned "derricking angle 2" and calculates the working radius and load factor based on the re-calculated "derricking angle 3". The calculator 22 then determines whether the newly calculated load factor is greater than the set load factor. The calculator 22 continues the above processes until the calculated load factor becomes equal to or smaller than the set load factor.

(Step SA17)

When it is determined that the calculated load factor is equal to or smaller than the set load factor (i.e., when the determination result in Step SA15 is NO), the calculator 22 determines whether the calculated load factor is equal to the set load factor.

(Step SA18)

When it is determined that the calculated load factor is not equal to the set load factor (i.e., when the determination result in Step SA17 is NO), the calculator 22 assigns the "derricking angle 3" calculated in Step SA12 as the "derricking angle 1".

(Steps SA12 to SA18)

The calculator 22 re-calculates the "derricking angle 3" based on the newly assigned "derricking angle 1" and calculates the working radius and load factor based on the re-calculated "derricking angle 3". The calculator 22 then determines whether the newly calculated load factor is greater than the set load factor. The calculator 22 continues the above processes until the calculated load factor becomes equal to the set load factor.

(Step SA19)

When it is determined that the calculated load factor is equal to the set load factor (i.e., when the determination result in Step SA17 is YES), the calculator 22 displays the working radius calculated in Step SA13 on the first working radius indicator 331 (see FIG. 3) of the monitor 31.

When it is determined that the current load factor is equal to the set load factor in Step SA9 (i.e., when the determination result in Step SA9 is YES), the calculator 22 displays the working radius calculated in Step SA4 on the first working radius indicator 331 (see FIG. 3) of the monitor 31.

Further, the calculator 22 also calculates the working radius corresponding to the warning load factor (90%) in the same manner as the above Steps SA4 to SA19 and displays the calculated working radius on the second working radius indicator 332 (see FIG. 3).

Note that the calculator 22 displays the rated working radius, which is stored in the calculator 22 in advance, as the working radius corresponding to the limit load factor (100%) on the third working radius indicator 333 (see FIG. 3) of the monitor 31.

The calculator 22 displays the working radiuses corresponding to the load factors (80%, 90%, and 100%) on the first to third working radius indicator 331-333, as explained above.

As mentioned above, the work state monitoring device 21 according to this embodiment is configured to calculate at least the prior-warning work state (predetermined work state) based on the current work state including the current actual weight and to inform the operator of the calculated prior-warning work state. With this, the work state monitoring device 21 according to the embodiment can inform the operator of the prior-warning work state in advance. As a result, the work state monitoring device 21 according to the embodiment can allow the operator perform the work without receiving a warning (i.e., without lighting the yellow light 33).

Further, the work state monitoring device 21 according to the embodiment is configured to use the working radiuses as the prior-warning work state (predetermined work state) to be informed to the operator. With this, the operator can easily recognize the work state, thereby enabling of the work without receiving a warning.

(Weight Indicating Process)

Figure 5:
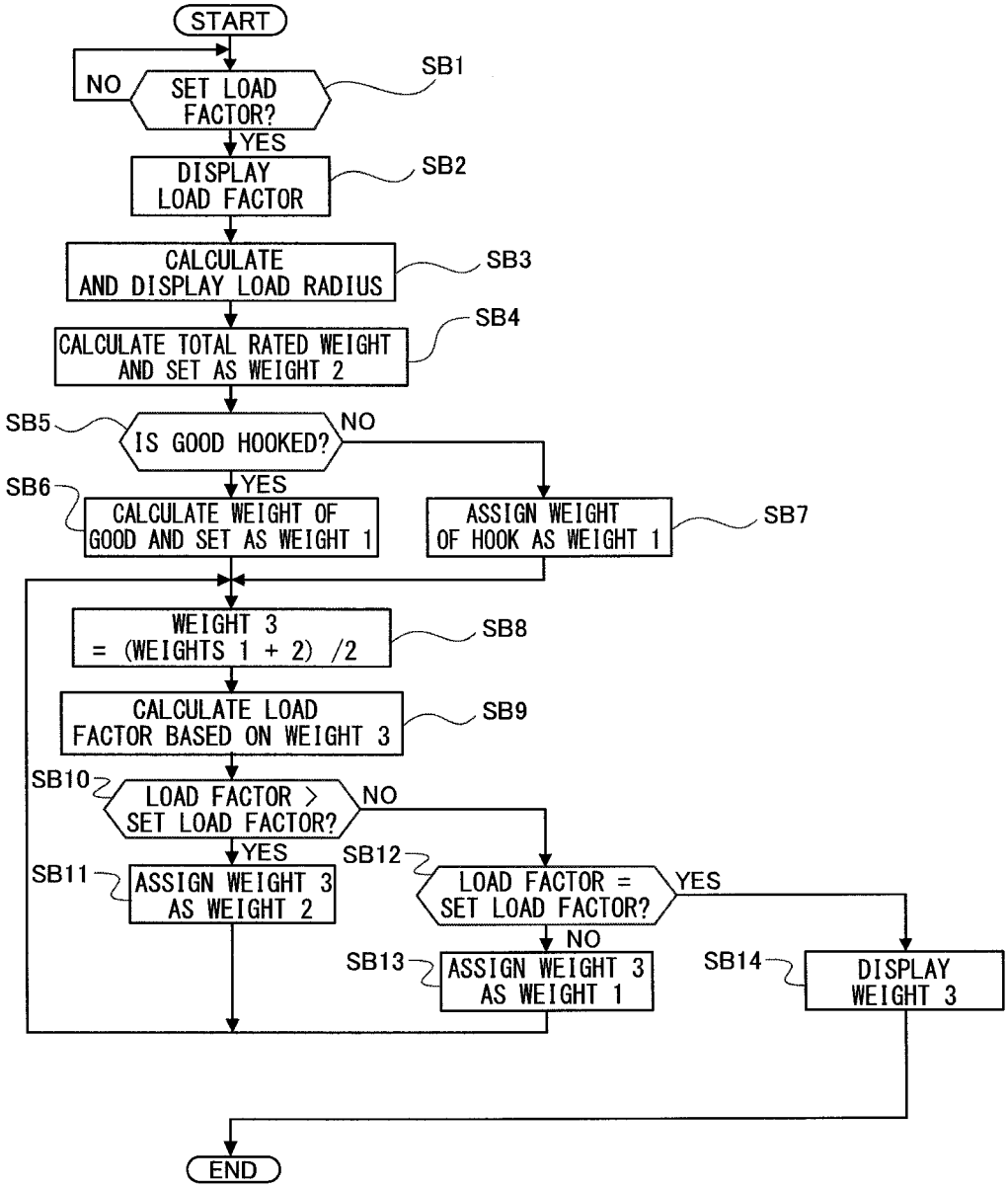
FIG. 5 is a flowchart showing processes executed by the work state monitoring device of the embodiment for displaying actual weights.

Next, the weight indicating process will be explained with reference to FIG. 5 flowchart.

(Step SB1 to Step SB2)

Since the processes in Steps SB1 to SB2 are identical to those in Steps SA1 to SA2, the explanation is omitted.

(Step SB3)

The calculator 22 calculates the current working radius based on the values detected by the rotating angle detector 23, jib-tilt angle detector 24, jib length detector 25, outrigger extension length detector 26, boom length detector 27, and boom angle detector 28. The calculator 22 then displays the calculated working radius on the current working radius indicator 344 of the monitor 31.

(Step SB4)

The calculator 22 further calculates the rated total weight based on the current working radius calculated in Step SB3 and assigns the rated total weight as a "weight 2".

(Step SB5)

The calculator 22 determines whether a good is hooked by the boom 7. This determination is made based on a change amount of the pressure of the boom cylinder 9 detected by the cylinder-pressure sensor 29, a change amount of the derricking angle of the boom 7 detected by the boom angle detector 28, and/or the like.

(Step SB6)

When it is determined that a good is hooked by the boom 7 (i.e., when the determination result in Step SB5 is YES), the calculator 22 calculates the weight of the good based on the change amounts of the pressure of the boom cylinder 9, the change amount of the derricking angle of the boom 7, and the like. The calculator 22 then assigns the calculated weight of the good as a "weight 1".

(Step SB7)

When it is determined that no good is hooked by the boom 7 (i.e., when the determination result in Step SB5 is NO), the calculator 22 assigns the weight of the hook 11, which is stored in the calculator 22 in advance, as the "weight 1".

(Step SB8)

Based on the "weight 1" assigned in Step SB6 or Step SB7 and the "weight 2" assigned in Step SB4, the calculator 22 calculates a weight 3 in accordance with the following equation:

$$\text{weight 3}=(\text{weight 1}+\text{weight 2})/2.$$

(Steps SB9 to SB10)

The calculator 22 calculates the load factor (virtual load factor) based on the "weight 3" calculated in Step SB8 and determines whether the calculated load factor is greater than the set load factor.

(Step SB11)

When it is determined that the calculated load factor is greater than the set load factor (i.e., when the determination result in Step SB10 is YES), the calculator 22 assigns the "weight 3" as the "weight 2".

(Steps SB8 to SB11)

The calculator 22 re-calculates the "weight 3" based on the newly assigned "weight 2" and calculates the load factor based on the re-calculated "weight 3". The calculator 22 then determines whether the newly calculated load factor is greater than the set load factor. The calculator 22 continues the above processes until the calculated load factor becomes equal to or smaller than the set load factor.

(Step SB12)

When it is determined that the calculated load factor is smaller than the set load factor (i.e., when the determination result in Step SB10 is NO), the calculator 22 determines whether the calculated load factor is equal to the set load factor.

(Step SB13)

When it is determined that the calculated load factor is not equal to the set load factor (i.e., when the determination result in Step SB12 is NO), the calculator 22 assigns the "weight 3" calculated in Step SB 8 as the "weight 1".

(Step SB8 to SB13)

The calculator 22 re-calculates the "weight 3" based on the newly assigned "weight 1" and calculates the load factor based on the re-calculated "weight 3". The calculator 22 then determines whether the newly calculated load factor is equal to the set load factor. The calculator 22 continues the above processes until the calculated load factor becomes equal to the set load factor.

(Step SB14)

When it is determined that the calculated load factor is equal to the set load factor (i.e., when the determination result in Step SB12 is YES), the calculator 22 displays the weight 3 on the first weight indicator 341 (see FIG. 3) of the monitor 31 as the actual weight.

Further, the calculator 22 also calculates the actual weight corresponding to the warning load factor (90%) in the same manner as the above Steps SB3 to SB14 and displays the calculated actual weight on the second weight indicator 342 (see FIG. 3).

Note that the calculator 22 displays the rated total weight, which is stored in the calculator 22 in advance, as the actual weight corresponding to the limit load factor (100%) on the third weight indicator 343 (see FIG. 3) of the monitor 31.

The calculator 22 displays the actual weights corresponding to the load factors (80%, 90%, and 100%) on the first to third weights indicators 341-343, as explained above.

As explained above, the work state monitoring device 21 according to this embodiment is configured to use the current actual weight and the current working radius and to inform the operator of at least the prior-warning work state (predetermined work state).

Therefore, the work state monitoring device 21 can inform the operator of the prior-warning work state (predetermined work state) in advance. As a result, the work state monitoring device 21 according to the embodiment can allow the operator perform the work without receiving a warning (i.e., without lighting the yellow light 33).

Further, the work state monitoring device 21 according to the embodiment is configured to use the actual weights as the prior-warning work state (predetermined work state) to be informed to the operator. With this, the operator can easily recognize the prior-warning work state (predetermined work state), thereby enabling of the work without receiving a warning.

Note that the operator may arbitrarily set the timing to turn ON the buzzer 32 with respect to the load factors using the operation unit 30 so as to sound the buzzer 32 when the current load factor reaches a set load factor to turn ON the buzzer 32.

Note that the work state monitoring device 21 may also sound the buzzer 32 before the current load factor reaches the set load factor to turn ON the buzzer 32. In this case, the alarm sound made when the current load factor reaches the set load factor and the alarm sound made before the current load factor reaches the set load factor are preferably distinguished.

Although the present invention has been described in terms of exemplary embodiments, it is not limited thereto. It should be appreciated that variations or modifications may be made in the embodiments without departing from the scope of the present invention as defined by the claims.

In the above explanation, the work state monitoring device 21 of the embodiment of the present invention includes the working radius indicating process and the actual weight indicating process. However, the work state monitoring device 21 of the present invention may include only one of the processes.

In the work state monitoring device 21 of the embodiment, the operator inputs a load factor (arbitrary load factor), and the device 21 displays the prior-warning work state (predetermined work state). However, the load factor may not be input by the operator but may be stored in the calculator 22 in advance.

The work state monitoring device 21 of the embodiment uses the boom length detector 27 and the like as the work posture detector. However, the work posture detector may be virtually replaced with the calculator 22 to simulate the prior-warning work state (predetermined work state).

The work state monitoring device 21 of the embodiment displays the working radiuses or the actual weight corresponding to the load factors as the prior-warning work state (predetermined work state). However, the device 21 may display the derricking angles under the working radiuses corresponding to the load factors, instead of the working radiuses.

The work state monitoring device 21 of the embodiment may automatically stop the crane 1 when the current load factor reaches a load factor that is smaller than the limit load factor (100%).

The work state monitoring device 21 of the embodiment calculates the working radiuses corresponding to the set load factors by virtually increasing and decreasing the derricking angles. However, the device 21 may calculate the working radiuses by virtually increasing and decreasing the extension amounts of the boom 7. Further, in consideration of the operations of extending and contracting the boom 7 or of rotating the swivel base 3, the device 21 may display the prior-warning work state corresponding to the set load factor three-dimensionally.

For example, in consideration of rotating the swivel base 3, the work state monitoring device 21 may use a screen that can display three-dimensional image to display a rotating position (as the prior-warning work state) corresponding to the set load factor under the current actual weight. Further, the device 21 may display a total rated weight curve on the screen and the working radius corresponding to the set load factor on the total rated weight curve.

Although the work state monitoring device 21 according to the embodiment is applied to the crane 1, the device 21 may be applied to other work vehicle such as a high lift work vehicle.

Although not illustrated, a high lift work vehicle includes a main body of a vehicle (vehicle body), a boom rotatably installed on the vehicle body, and a bucket connected with a top end of the boom. In this case, the boom and bucket correspond to the working device of the present invention.

The actual weight of the high lift work vehicle is a weight on the top end of the working device (i.e., a sum of a weight of the bucket, a weight of the operator, and a total weight of tools carried in the bucket). The working radius of the high lift work vehicle is a horizontal distance from the rotation center of the boom (i.e., the center of the connection point of boom) to the edge of the bucket.

The work state monitoring device 21 of the embodiment is configured to detect the actual weight by the cylinder pressure sensor 29 installed on the boom cylinder 9. However, it should not be limited to the cylinder-pressure sensor 29.

The invention claimed is:

1. A work state monitoring device for a work vehicle, comprising:

a work state acquisition section that acquires a current work state of the work vehicle;

a calculator that calculates:

a first predetermined work state, which represents a work state prior to receiving a warning, corresponding to a load factor set lower than a warning load factor to generate the warning based on the current work state acquired by the work state acquisition section, a second predetermined work state, which represents a work state close to a work limit, corresponding to the warning load factor, and a third predetermined work state, which represents a work state, corresponding to the work limit; and an informer that informs an operator of the first predetermined work state and the second predetermined work state.

2. The device as claimed in claim 1, wherein the work vehicle includes a vehicle body and a working device attached to the vehicle body for operating a work, as the current work state, the work state acquisition section acquires a current actual weight representing an actual weight on a top end of the working device, as the first predetermined work state, the calculator calculates a working radius representing a horizontal distance from a connection point of the working device with the vehicle body to the top end of the working device based on the acquired current actual weight, and the informer informs the operator of the calculated working radius.

3. The device as claimed in claim 1, wherein the work vehicle includes a vehicle body and a working device attached to the vehicle body for operating a work, as the current work state, the work state acquisition section acquires a current working radius representing a horizontal distance from a connection point of the working device with the vehicle body to a top end of the working device, as the first predetermined work state, the calculator calculates an accrual weight representing an actual weight on the top end of the working device based on the acquired current working radius, and the informer informs the operator of the calculated actual weight.

4. The device as claimed in claim 1, wherein the work vehicle includes a vehicle body and a working device derrickably attached to the vehicle body for operating a work, as the current work state, the work state acquisition section acquires a current actual weight representing an actual weight on a top end of the working device, as the first predetermined work state, the calculator calculates a derricking angle based on the acquired current actual weight, and the informer informs the operator of the calculated derricking angle.

5. The device as claimed in claim 1, wherein the calculator calculates the first predetermined work state as variable values continuously updated within a range, in which the work state is prior to receiving a warning, and wherein the informer indicates the continuously updated variable values.

* * * * *